United States Patent [19]

Mitrzyk, Sr. et al.

[11] 4,309,928

[45] Jan. 12, 1982

[54] APPARATUS FOR SIMULTANEOUSLY CUTTING WIRE SEGMENTS FROM A PLURALITY OF WIRES

[75] Inventors: Jan C. Mitrzyk, Sr., Unadilla; Rodney W. Gossoo, Sidney Center; Charles P. Fischer, Sidney; Howard N. Silvernail, Otego; Charles Null, Oneonta, all of N.Y.

[73] Assignee: The Bendix Corporation, Southfield, Mich.

[21] Appl. No.: 153,305

[22] Filed: May 27, 1980

[51] Int. Cl.[3] ..... B21F 11/00

[52] U.S. Cl. ..... 83/161; 83/277; 83/387; 83/465; 83/480; 83/481; 83/694

[58] Field of Search ..... 83/277, 282, 387, 389, 83/460, 465, 580, 581, 694, 454, 161, 167

[56] References Cited

U.S. PATENT DOCUMENTS

| | | | |
|---|---|---|---|
| 2,353,405 | 7/1944 | King | 83/277 X |
| 3,212,380 | 10/1965 | Göbel et al. | 83/277 X |
| 3,248,981 | 5/1966 | Kafka | 83/694 X |
| 3,590,677 | 7/1971 | Smith | 83/465 X |
| 3,598,009 | 8/1971 | Reger | 83/277 X |
| 3,947,958 | 4/1976 | Bowers | 83/277 X |
| 3,983,772 | 10/1976 | Oldham | 83/580 X |

*Primary Examiner*—James M. Meister

*Attorney, Agent, or Firm*—W. G. Kratz; R. J. Eifler

[57] ABSTRACT

An apparatus for simultaneously cutting wire segments having acutely angled ends from a plurality of wires including guide apparatus and feeding apparatus for the wires, and a cutting device comprising a base, reciprocable shear plate and clamp plate, each of which has parallel grooves therein, with each also having sliding surfaces that are at an acute angle to the axis of the grooves. A collection plate is also provided to contain cut segments and transfer the segments to a common collection point.

13 Claims, 9 Drawing Figures

APPARATUS FOR SIMULTANEOUSLY CUTTING WIRE SEGMENTS FROM A PLURALITY OF WIRES

BACKGROUND OF THE INVENTION

This invention is related to electrical connectors, and is a wire cutting apparatus usable to simultaneously cut a plurality of wire segments from a corresponding plurality of wires, with a smooth cut effected so as to provide acute angular ends on the wire segments without burrs. The apparatus is especially useful in cutting segments from a plurality of wires that are of a small diameter, where a clean cut is required, and where loss of material from the wires due to a cutting operation is to be avoided.

The apparatus is usable, for example, in cutting a plurality of short segments from a plurality of small diameter, electrically conductive wires usable in electrical brush contacts. For example, in U.S. Pat. No. 3,725,844, assigned to the assignee of the present invention, a brush contact is described which is formed from a plurality of short, small diameter wire segments having acute angular surfaces, that are retained in a holder. In the formation of such segments, extreme care must be taken so as to avoid any burrs or excess material along the angular edges of the wire segment ends that would interfere with placement of the wire segments into a holder or interfere with mating of the exposed ends of the wire segments with the exposed ends of the wire segments of a contact to be mated therewith. As described in U.S. Pat. No. 3,725,844, the contents of which are incorporated by reference herein, fine wires of expensive material are used in the brush contacts. Where beryllium-copper wires having a precious metal coating thereon are used in such contacts, the wires only have a diameter of between 0.01–0.001 inch, while the length of the wires of the contact are only about 0.375 inch. An automatic system for producing such wires, by cutting segments from reels of such wire, requires that the cutting of segments be done cleanly and quickly, such that the wire ends be angularly cut without burrs. As described in the above mentioned patent, the ends of wires used to form the brush contacts have acute angular ends, preferably having an angular surface of about 30° to the axis of the wire.

In automated formation of such wire segments, it is imperative that the segments be cut at a high rate of speed in order to provide a plurality of segments for each holder that is to form the brush contact. Thus, production of a plurality of such wire segments, simultaneously, from wires is required in order to obtain the desired manufacturing speed for brush contact assembly.

The present apparatus provides means for simultaneously cutting a plurality of wire segments from a plurality of wires and also a means for passing the cut segments to a common collection point.

SUMMARY OF THE INVENTION

The present apparatus comprises a wire cutting apparatus that cuts segments from a plurality of wires and feeds the segments to a common collection point, the segments having acutely angled ends. The apparatus has a plurality of parallel guide means for the wires, and means for intermittently feeding the wires in parallel relationship to a cutting means. The cutting means simultaneously shears a segment from each of the plurality of wires and has a pressure pad, for restraining wires during shearing, having a first sliding surface and a coplanar base member having a second sliding surface, and a reciprocable shear plate having a third sliding surface. The pressure pad has a plurality of grooves therein that are axially aligned with grooves in the shear plate, the pressure pad and shear plate having complementary sliding surfaces, all of which sliding surfaces are at a common acute angle relative to the axes of the grooves. A collection plate is provided to contain the cut segments and transfer the segments to a common collection point.

DETAILED DESCRIPTION

The present apparatus enables cutting of segments from a plurality of wires simultaneously to give clean, acutely angled end surfaces on the segments, and transfer of the cut segments to a common collection point for further use.

Figure 1:
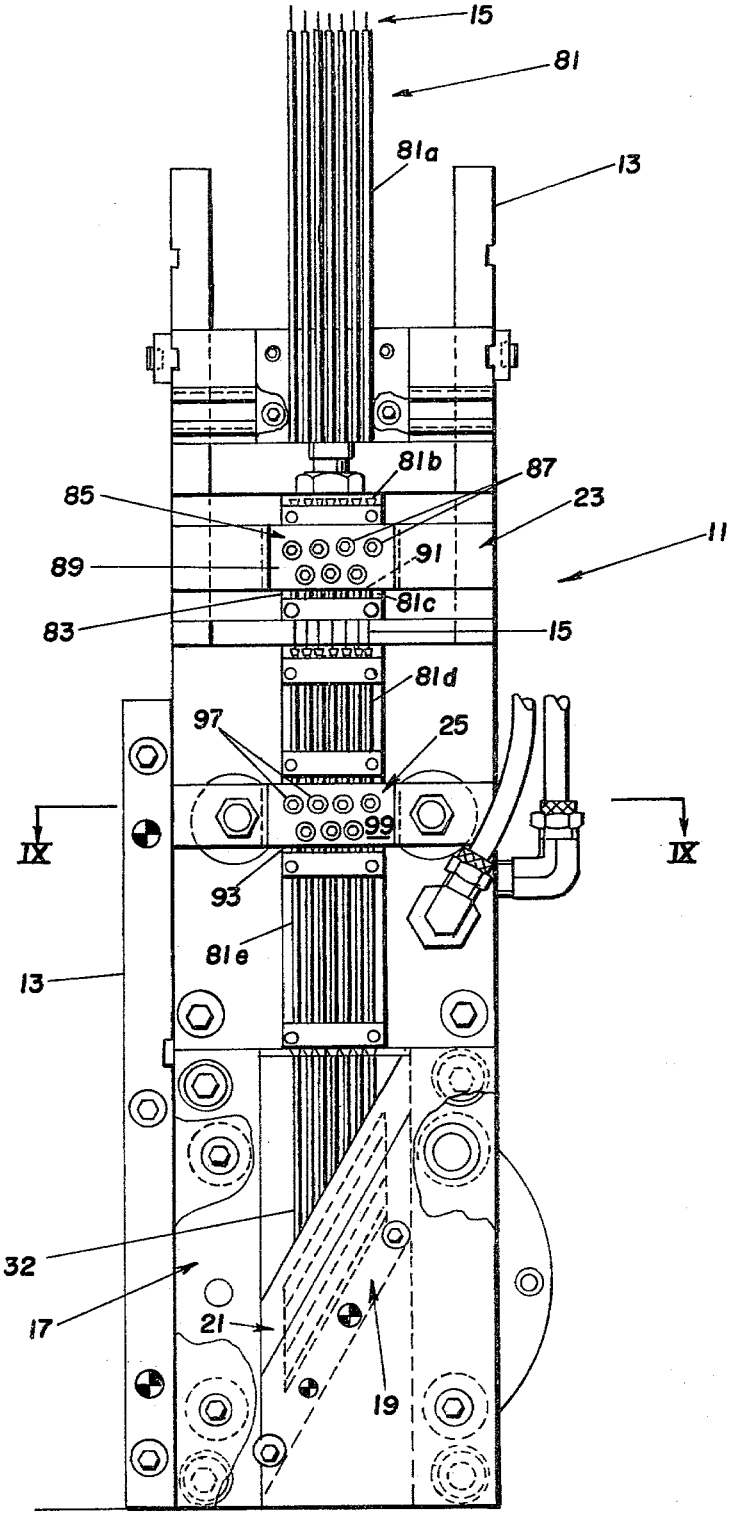
FIG. 1 is a schematic illustration, in elevation, of the apparatus of the present invention.
Figure 2:
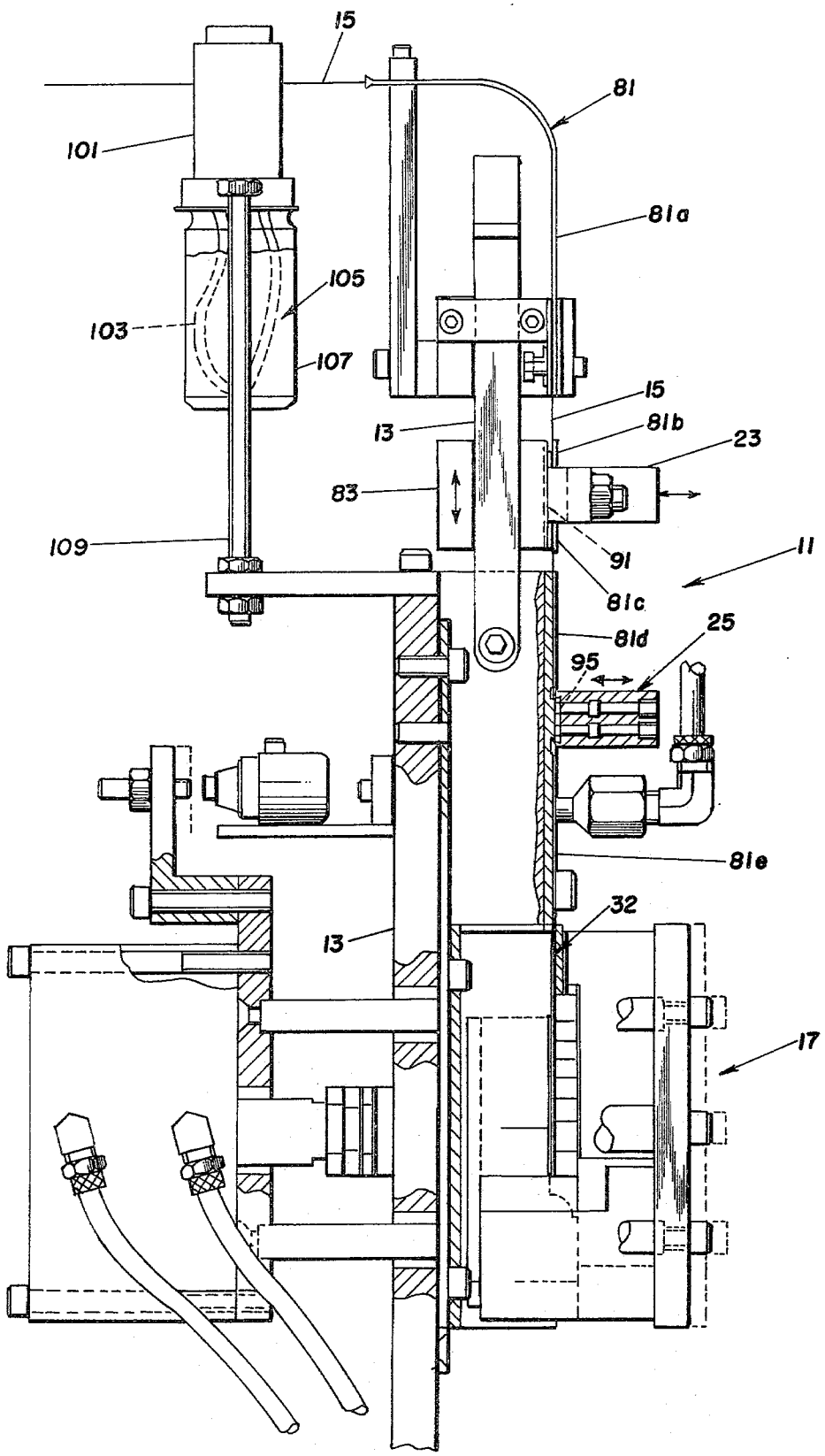
FIG. 2 is a side elevation of the apparatus of FIG. 1, with portions thereof cut away to expose various parts.

Referring to FIGS. 1 and 2, the apparatus is schematically illustrated so as to follow operation of the apparatus. As illustrated, the apparatus 11 is supported on a support base such as vertical supports 13. A plurality of wires 15, from which segments 15' are to be cut, are fed to the apparatus 11 by means (not shown) which will feed the wires in parallel relationship to each other, the wires having parallel axes. The plurality of wires 15 are fed to the cutting means 17 wherein segments 15' are cut simultaneously from each of the wires 15 by use of a shear means 19 and cooperating clamp means 21. A feed means 23 for intermittently feeding the wires 15 into the cutting means 17 is provided, as is a clamp means 25 that clamps the wires firmly to prevent movement thereof during the operation of the cutting means.

Figure 3:
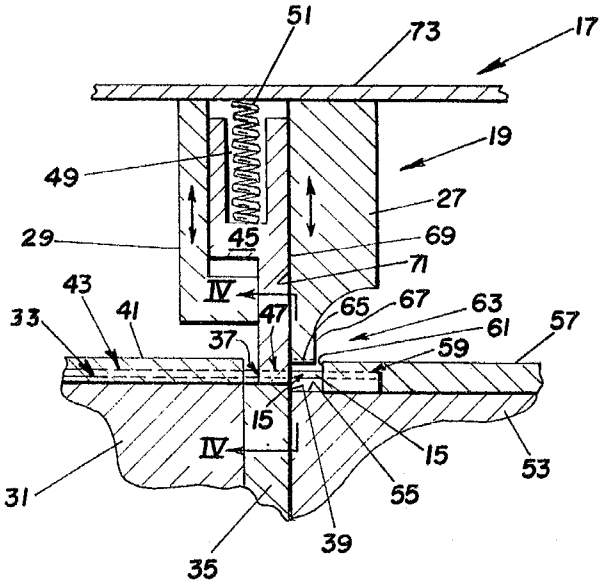
FIG. 3 is a cross-sectional view of the cutting means of the apparatus of the present invention prior to cutting a plurality of wire segments.
Figure 4:
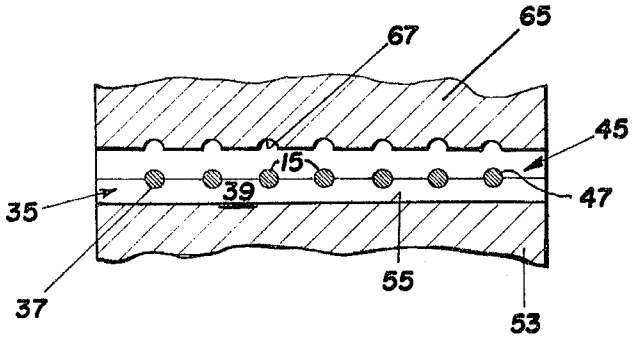
FIG. 4 is a view taken along the lines IV—IV of FIG. 3.

The cutting means 17 is shown in cross-section in FIG. 3, and has a reciprocable shear plate 27 and coacting reciprocable cap 29. A supporting and clamping device is provided at the cutting means to support the wires 15 in secure, parallel relationship. A support surface for wires 15 being fed to the cutting means 17 comprises a guide base 31 having tubular wire guides 43 contained in grooves 33 therein, and a base member or die plate 35 having grooves 37 therein which cooperate with grooves 33. A sliding surface 39 is provided on clamp base 35. A first cover plate 41 is superimposed over the guide base 31 and the stainless steel tubes 43 are clamped by the cover plate. Above the base member 35, there is positioned a pressure pad 45, the pad having grooves 47 therein which are complementary to the grooves 37 in base member 35. The pressure pad 45 also has therein a plurality of bores 49, each of which is adapted to contain a spring 51 for the purposes hereinafter explained.

Abutting the base member 35 is a collection base 53 which has a smooth upper surface 55, which surface 55 is displaced from the upper surface and grooves 37 in base member 35, and coplanar therewith. There is superimposed over the collection base 53 a second cover plate 57, which cover plate has grooves 59 formed therein. The grooves 59 are axially aligned with the grooves 37 in base member 35, but are of a larger dimension. The terminus 61 of the second cover plate 57 is spaced from a sliding surface 39 of base member 35 so as to leave a gap 63 for receiving the shear means 19. Shear means 19 comprises the reciprocable shear plate 27, the terminus 65 of which has grooves 67 therein, which grooves are axially aligned with grooves 37 in base member 35, grooves 47 in pressure pad 45, and also with grooves 59 in second cover plate 57. A first sliding surface 69 is provided on pressure pad 45 and a third sliding surface 71 is provided on shear plate 27 to enable sliding of those two components relative to each other. A punch plate 73 is provided in contact with the shear plate 27 and cap 29 and is arranged to be reciprocably movable towards and away from the planes of the surfaces of bases 31, 35 and 53.

The position of the various elements of the shear means 19, upon shearing of a plurality of segments 15' simultaneously from a plurality of wires 15, is illustrated in FIGS. 3 to 6. Upon feeding of the plurality of parallel wires 15 through the tubes 32 situated in cooperating grooves 33 and 43, and through cooperating grooves 37 and 47 coaxial therewith, a predetermined portion of the wires 15 will extend beyond the second sliding surface 39 of the base member 35. Upon actuation of the punch plate 73, the shear plate 27 will move in the direction of the smooth surface 55 of collection base 53, with the third sliding surface 71 of the shear plate 27 sliding along complementary first sliding surface 69 of the pressure pad 45. At the same time, coacting cap 29 will move in the direction of the first cover plate 41, this movement compressing springs 51 in bores 49 of the pressure pad, to increase pressure on the portion of the wires 15 in grooves 47 of the pressure pad and assure a rigid and secure fixing of the wires 15. As the shear plate 27 continues its movement towards smooth surface 55, the portions of the wires 15 extending beyond the second sliding surface 39 of the base member 35 are trapped in the grooves 67 of the terminus 65 of the shear plate 27 to prevent any lateral shifting thereof. Upon completion of the movement of shear plate 27 towards the smooth surface 55 of collection base 53, with third sliding surface 71 of the shear plate 27 sliding along second sliding surface 39 of the base member 35, the segments 15' are simultaneously sheared or cut from the plurality of wires 15 without any burrs or rough edges.

Upon cutting of a series of segments 15' from the plurality of wires 15, the punch plate 73 is retracted from its actuated position, by the aid of spring 49, and retracts shear plate 27 and cap 29 therewith, so as to situate the cutting means in position for receipt of further portions of wires 15 and a subsequent cutting cycle.

Figures 7, 9:
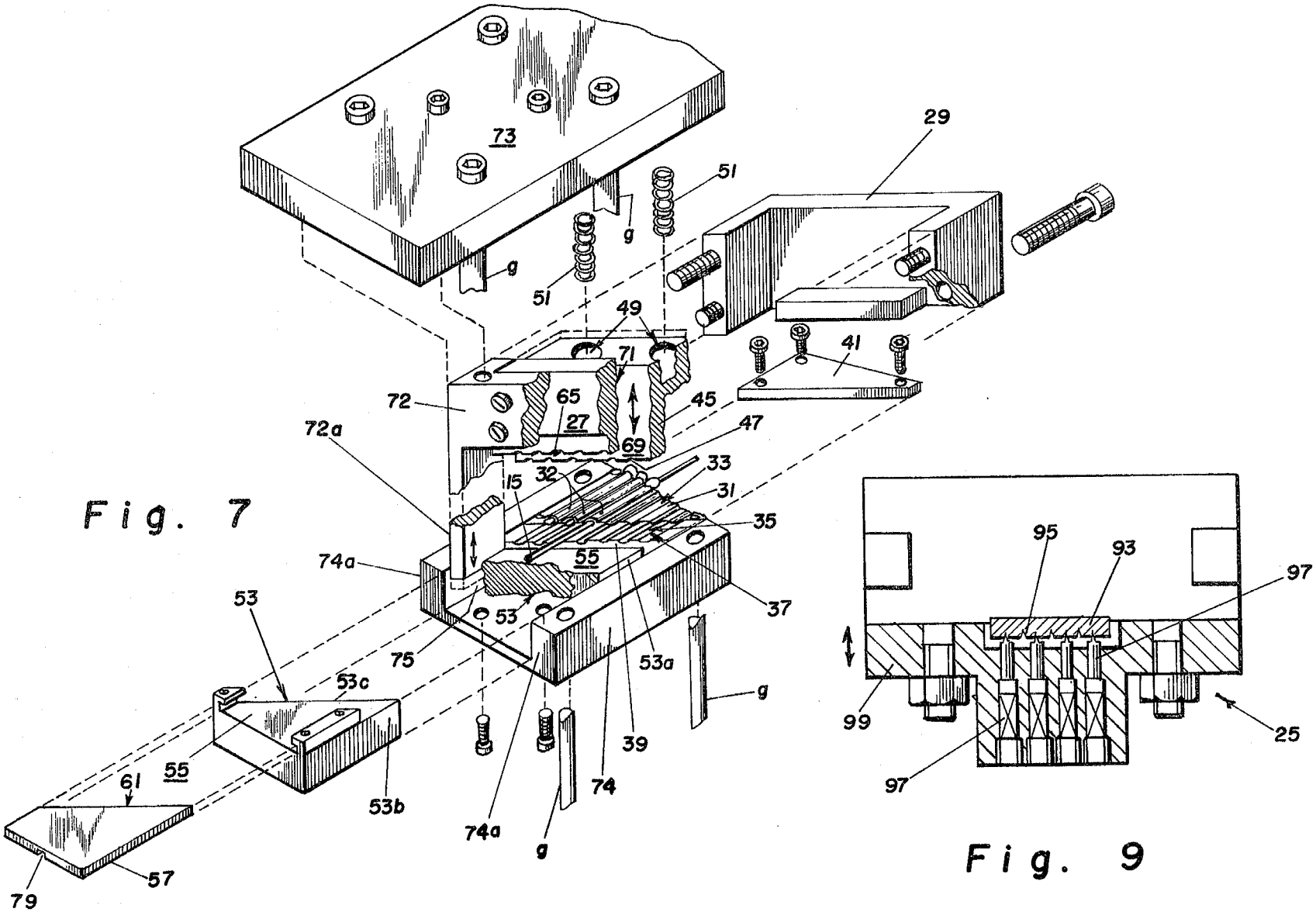
FIG. 7 is an exploded view of the preferred arrangement of the cutting means which provides excellent alignment of the parts thereof.
FIG. 9 is a cross-sectional view taken along lines IX—IX of FIG. 1.

In FIG. 7, an exploded detailed view of the arrangement of the various sections of the cutting means 17 is illustrated, which shows the arrangement which provides an interlocking and self-aligning construction. A lower die chase 74 of U-shaped design, having upwardly extending walls **74*a*, is provided within which the guide base 31, base member 35, and collection base 53 are seated. The ends 31*a* of the guide base 31 and the ends 35*a* of the base member 35 are flush with the walls 74*a* of the die chase 74 to provide alignment thereof. The collection base 53 having end walls 53*a* may, however, be divided into two sections, 53*b* and 53*c*, as illustrated, wherein 53*b* acts as a punch chase guide block while 53*c* acts as a lower guide, both sections however having a smooth upper surface 55. The end walls 53*a* of the two sections 53*b* and 53*c* however terminate spaced from the walls 74*a* of the lower die chase 74 such that a gap 75 is provided. A punch chase 72, intermediate the punch plate 73 and lower die chase 74 has downwardly depending legs 72*a* which fit in the gap 75. By providing that the legs 72*a* of the punch chase 72 remain within the gap 75 between end walls 53*a* and 74*a*, during reciprocating movement of the shear plate 27 by means of movement of punch plate 73 along guide rods g, there is no problem of misalignment of the shear plate during such movement. The use of two sections 53*b* and 53*c*** for the collection plate also enables easy maintenance thereof. The alignment so provided results in an interlocking, self-aligning and guiding system that maintains precise alignment of the wire grooves that insures that the plurality of wire segments cut from the plurality of wires are cut smoothly to provide acute angular ends on the wire segments without burrs. During setting up of the system, the component parts can be adjusted to provide for minimum or zero clearance between the shear plate and pressure pad and base member, and also allows for resharpening and servicing of the apparatus.

Figure 8:
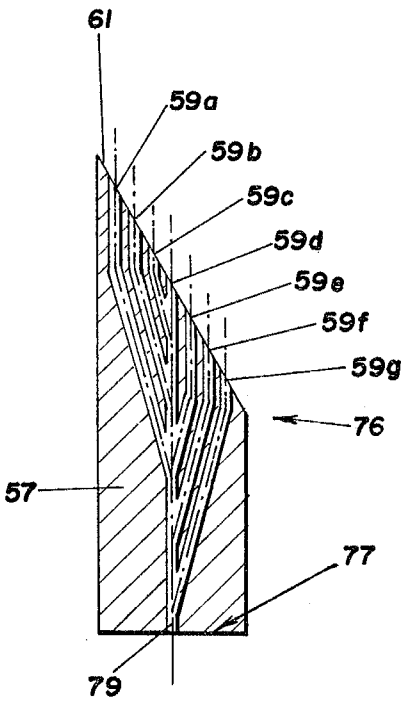
FIG. 8 is a plan view of the underside of the collection means for the cut wire segments.
Figure 5:
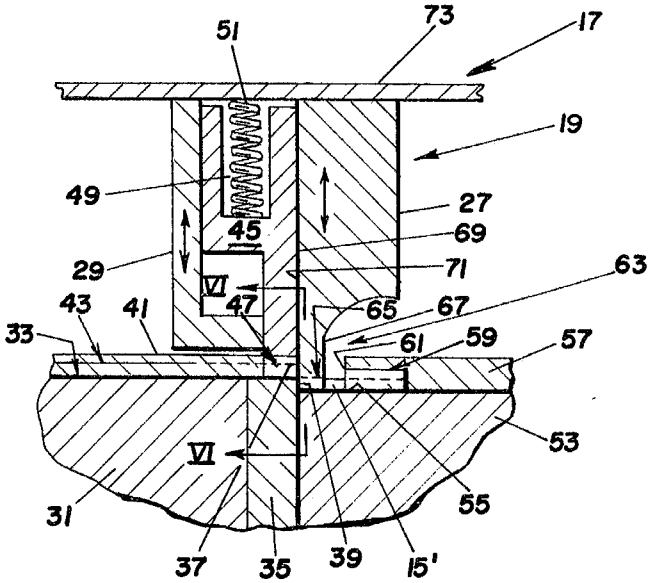
FIG. 5 is a cross-sectional view of the cutting means of the apparatus of the present invention subsequent to shearing of a plurality of wire segments.
Figure 6:
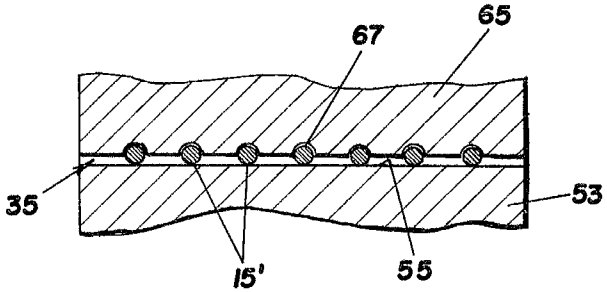
FIG. 6 is a view taken along the lines VI—VI of FIG. 5.

A further important aspect of the present invention is the collection of the cut segments 15' such that the segments 15' may be axially fed to a common collection point for insertion into a common holder or other end use. The wires 15 are fed past the sliding surface 39 of base member 35, and the terminus 61 of second cover plate 57 is spaced from the sliding surface 39 of the base member 35 a distance such that at least about forty percent of the length of the segments 15' that are to be cut from wires 15 are positioned in slots 59 of the second cover plate 57, and between cover plate 57 and smooth surface 55 of the collection base 53. As seen in FIG. 8, the second cover plate 57 has grooves 59 therein, at the end 76 of the cover plate 57, which are coaxial with grooves 67 in the terminus 65 of the shear plate 27. The other end 77 of the second cover plate 57 contains a single groove 79 therein, from which segments 15', cut from the plurality of wires 15, are discharged. In the embodiment illustrated in the present drawings, seven wires are simultaneously cut, and seven wire segments 15' are produced, although the apparatus may be designed to cut more or less such wires. The seven wire segments 15' are, as before described, positioned in alignment with the grooves 59, upon formation of the segments 15', with at least forty percent of the length of each segment positioned within the grooves. These segments 15' are situated within grooves **59*a*, 59*b*, 59*c*, 59*d*, 59*e*, 59*f* and 59*g*. With vertical placement of the cutting aparatus, each of the segments 15' will be vertically positioned, with a portion thereof trapped in respective grooves 59*a*–59*g*. The grooves 59***a*–59*g* are of larger size than the diameter of the wire segments 15′, however, such that upon retraction of the shear plate 27, the segments are free to fall by gravity along smooth surface 55 of collection base 53 and are only guided in their free fall by the grooves 59*a*–59*g*. In the embodiment illustrated, the groove 59*d* terminates as single groove 79, while the other grooves, 59*a*, 59*b*, 59*c*, 59*e*, 59*f* and 59*g* extend towards the central groove 59*d*, along the length of the second cover plate 57, with segments 15′ falling through their respective, independent, initial groove into the central groove 59*d* and thence through single groove 79 to a common collection point. Because of the clean shear of the segments 15′ from the wires 15, no burrs or rough edges will be present on the segments 15′ which would retard their free fall between second cover plate 57 and the smooth surface 53, enabling the use of gravity for feeding the segments to a common collection point through single groove 79.

As illustrated in FIGS. 1 and 2, a plurality of parallel guide means 81, such as tubular members, are provided to guide the thin wires from a source, such as rolls thereof (not shown) to the grooves 33 of the guide base 31 and thence to the grooves 47 of the pressure pad 45. As illustrated, the guide means may be in the form of a series of axially aligned, spaced tubes 81*a*, 81*b*, 81*c*, 81*d* and 81*e* with the wires 15 passing through the axially aligned tubes, with spacing provided between certain of the spaced tubes for feeding of the wires 15 and clamping of the same for intermittent feeding to the cutting means 17. The wires, from a source not shown, are passed through axially aligned tubes 81*a*, and passed through the tubes 81*a* to spaced tubes 81*b*, which are adjacent the feed means 23. Spaced from axially aligned tubes 81*b* and in axial alignment therewith are tubes 81*c*, also adjacent the feed means 23, with the wires exposed in the spacing between tubes 81*b* and 81*c*. This exposure of the wires enables clamping and feeding of the wires at the feed means 23. The wire feed means 23 comprises a reciprocable plate 83 and coacting clamp means 85, both of which are arranged to reciprocate, in unison, along spaced supports 13. The clamp means 85 has a plurality of punch clamps 87, shown in the drawing as seven such clamps, which are movable towards and away from the plate 83. In the illustrated embodiment, four of the punch clamps 87 are spaced in one row, while three additional punch clamps are spaced in a parallel row with all attached to a common punch plate 89. The reciprocable plate 83 has grooves 91 therein through which the exposed wires 15 will be situated during the feeding operation.

The wires pass through tubes 81*c* and thence through tubes 81*d*, with the wires again being exposed between tubes 81*d* and tubes 81*e*, adjacent clamp means 25. Clamp means 25 (FIG. 9) comprises a stationary plate 93 having grooves 95 therein, which accept the wires 15, and a second series of punch clamps 97, also shown in the drawing in spaced rows of four and these such clamps, which are movable towards and away from the stationary plate 93 by activation of a common punch clamp 99.

In operation of the feed means 23 and clamp means 25, with the second punch plate 99 in spaced relationship to the wires 15 and station of the feed means 23 and clamp means 25, with the second punch plate 99 in spaced relationship to the wires 15 and stationary plate 93, the punch plate 89 is activated and the punch clamps 87 are moved towards the wires 15 at the reciprocable plate 83. The punch clamps thus secure the wires 15 in grooves 91 of the reciprocable plate 83. The feed means 23 then moves along supports 13, in the direction of feeding of the wires 15, both reciprocable plate 83 and clamp means 85 moving in unison. At the furthermost movement of the feed means 23, the clamp means 25 is activated with second punch plate 99 activated, so that the second series of punch clamps 97 secure the wires in grooves 95 of the stationary plate 93. With the wires secured by the clamp means 25, the punch plate 89 is activated to move punch clamps 87 away from wires 15. In this spaced relationship, the punch plate 89 and punch clamps 87 can be returned to rest position, along supports 13 for use in further intermittent feeding the wires.

The feeding mechanism thus assures that the fine wires 15 are continuously secured at all times during intermittent feeding thereof. The wires then pass through tubes 81*e*, through spaced tubes 32 and into the cutting means 17, the wires being fed at an intermittent and predetermined rate.

In order to assure easy passage of the wires 15 through the feed means and tubes, the wires may be initially fed through a cleaning means, such as a felt wiping system 101 and associated wick system 103 containing a cleaning solution 105 in container 107, supported by bases 109 connected to supports 13.

What is claimed is:

1. An apparatus for simultaneously producing a plurality of wire segments having acute angled ends from a plurality of wires, comprising:

(a) means for guiding said plurality of wires in a parallel relationship;

(b) means for cutting said wires, adjacent said guide means, to simultaneously cut a segment from each of said plurality of wires, said cutting means having:

(1) means for clamping said wires to be cut comprising a pressure pad and a confronting base member, both the pressure pad and base member having a plurality of grooves therein axially aligned with the guide means for said plurality of wires, said pressure pad having a first sliding surface and said base member having a second sliding surface coplanar with said first sliding surface, (2) means for shearing wire segments from said plurality of wires comprising a shear plate having grooves therein, axially aligned with the grooves of said pressure pad, and having a third sliding surface slidable along said first and second sliding surfaces of the pressure pad and confronting base member, all three of said sliding surfaces being at a common acute angle to the axes of said grooves, and (3) means for reciprocating said shear plate to shear portions of said plurality of wires and simultaneously form a plurality of wire segments;

(c) means for intermittently feeding portions of said plurality of wires through the clamp means and past the sliding surfaces of the cutting means;

(d) a segment supporting base, positioned adjacent said base member of the cutting means, having a smooth surface spaced from the grooves of said base member; and (e) a cover plate superimposed over the segment supporting base, the terminus of said cover plate being spaced from said base member of the cutting means, said cover plate having grooves therein coaxial with the grooves of said base member.

2. An apparatus as defined in claim 1 wherein said parallel guide means includes a guide base adjacent the base member of said cutting means, and a cover plate superimposed over said guide base, with grooves therein axially aligned with the grooves of said clamp means.

3. An apparatus as defined in claim 1 wherein said pressure pad includes means to increase the pressure of said pad on wires situated in the grooves thereof when the third sliding surface of the shear means slides along said first and second sliding surfaces of said pressure pad and base member.

4. An apparatus as defined in claim 3 wherein said pressure pad has bores therein and a spring in each said bore which bears against a punch plate, said punch plate arranged to move said shear means, and the third sliding surface thereof, along the first and second sliding surfaces of said pressure pad and base member.

5. An apparatus as defined in claim 1 wherein the grooves of said cover plate are larger than the grooves of said base member.

6. An apparatus as defined in claim 1 wherein the grooves of said cover plate converge to a common single groove such that wire segments entering the grooves are discharged from the single groove.

7. An apparatus as defined in claim 1 wherein the means for intermittently feeding said wires comprises a reciprocable plate and coacting feed clamp means reciprocable in unison in the direction of feeding of the wires.

8. An apparatus as defined in claim 7 wherein said reciprocable plate has parallel grooves therein in which the wires are situated and the coacting feed clamp means has punch clamps movable towards and away from the plate.

9. An apparatus as defined in claim 8 including a further feed clamp means intermediate said reciprocable plate and said cutting means.

10. An apparatus as defined in claim 1 including a lower die chase having upwardly extending walls within which the guide means, base member, and segment supporting base are situate, with the walls of the segment supporting base terminating in spaced relationship to said upwardly extending walls, and wherein a punch chase is provided having downwardly extending legs that are maintained within the space between the walls of the segment supporting base and said upwardly extending walls during reciprocation of the shear plate.

11. An apparatus as defined in claim 10 wherein said segment supporting base is comprised of two sections, both of which have a coplanar smooth upper surface.

12. An apparatus for simultaneously producing a plurality of wire segments having acute angled ends from a plurality of wires, comprising:

(a) means for guiding said plurality of wires in a parallel relationship;

(b) means for cutting said wires, adjacent said guide means, to simultaneously cut a segment from each of said plurality of wires, said cutting means having:

(1) means for clamping said wires to be cut comprising a pressure pad and a confronting base member, both the pressure pad and base member having a plurality of grooves therein axially aligned with the guide means for said plurality of wires, said pressure pad having a first sliding surface and said base member having a second sliding surface coplanar with said first sliding surface, said pressure pad having bores therein and a spring within each said bore, (2) means for shearing wire segments from said plurality of wires comprising a shear plate having grooves therein, axially aligned with the grooves of said pressure pad, and having a third sliding surface slidable along said first and second sliding surfaces of the pressure pad and confronting base member, all three of said sliding surfaces being at a common acute angle to the axes of said grooves, and (3) a reciprocable punch plate for reciprocating said shear plate to shear portions of said plurality of wires and simultaneously form a plurality of wire segments, said punch plate also bearing on the pressure pad and the springs therein to increase the pressure of said pad on wires situated in the grooves thereof;

(c) means for intermittently feeding portions of said plurality of wires through the clamp means and past the sliding surfaces of the cutting means;

(d) a segment supporting base positioned adjacent said base member of the cutting means, and having a smooth surface spaced from the grooves of said base member; and (e) a cover plate positioned over the segment supporting base having grooves therein larger than the grooves of the base member, which grooves converge to a common single groove such that wire segments entering the grooves are discharged from the single groove.

13. An apparatus as defined in claim 12 including a lower die chase having upwardly extending walls within which the guide means, base member, and segment supporting base are situate, within the walls of the segment supporting base terminating in spaced relationship to said upwardly extending walls, and wherein a punch chase is provided having downwardly extending legs that are maintained within the space between the walls of the segment supporting base and said upwardly extending walls during reciprocation of the shear plate.

* * * * *